US007055335B2

(12) United States Patent
van Leeuwen

(10) Patent No.: US 7,055,335 B2
(45) Date of Patent: Jun. 6, 2006

(54) VENTING ARRANGEMENT FOR A VEHICLE REFRIGERATOR AND RELATED METHOD

(75) Inventor: Jozef Hermanus van Leeuwen, Zundert (NL)

(73) Assignee: Norcold, Inc., Sidney, OH (US)

( * ) Notice: Subject to any disclaimer, the term of this patent is extended or adjusted under 35 U.S.C. 154(b) by 0 days.

(21) Appl. No.: 10/805,510

(22) Filed: Mar. 19, 2004

(65) Prior Publication Data

US 2005/0034475 A1 Feb. 17, 2005

Related U.S. Application Data

(60) Provisional application No. 60/456,703, filed on Mar. 21, 2003.

(51) Int. Cl.
*F25D 17/06* (2006.01)

(52) U.S. Cl. ..... 62/89; 62/404

(58) Field of Classification Search ..... 62/404, 62/428, 476, 485, 507, 239, 244, 101, 141, 62/148, 89, 339, 111; 126/84, 116 B, 312
See application file for complete search history.

(56) References Cited

U.S. PATENT DOCUMENTS 1,769,119 A * 7/1930 Davenport ..... 62/89
3,245,224 A * 4/1966 Wilkinson ..... 62/239
4,056,947 A * 11/1977 Partsch ..... 62/148
4,865,013 A * 9/1989 Teakell ..... 126/307 R
4,940,042 A * 7/1990 Moore et al. ..... 122/18.2
5,001,904 A * 3/1991 Blomberg ..... 62/238.3
5,020,512 A * 6/1991 Vago et al. ..... 122/18.2
5,291,749 A * 3/1994 Schulak ..... 62/183
5,355,693 A * 10/1994 McConnell et al. ..... 62/244
5,647,342 A * 7/1997 Jamieson et al. ..... 126/512
5,782,105 A * 7/1998 Stork ..... 62/331
5,966,965 A * 10/1999 Boxum ..... 62/485
6,318,098 B1 * 11/2001 Boxum ..... 62/183

FOREIGN PATENT DOCUMENTS

DE 2220285 B * 8/1978
EP 1010941 A2 * 6/2000
FR 2447524 A * 9/1980
JP 2002/340465 A * 11/2002

* cited by examiner

*Primary Examiner*—Mohammad M. Ali
(74) *Attorney, Agent, or Firm*—Harness, Dickey & Pierce, P.L.C.

(57) ABSTRACT

A venting arrangement for a vehicle refrigerator including a lower vent assembly and an upper vent assembly. The lower vent assembly provides ventilation intake for cooling of refrigeration components. The upper vent assembly provides ventilation exhaust for cooling of refrigeration components. The venting arrangement further includes a flue exhaust tube assembly. The flue exhaust tube assembly causes the combustion exhaust gases to mix with the ventilation air prior to being exhausted near the upper vent assembly and away from the refrigerator components.

16 Claims, 2 Drawing Sheets

VENTING ARRANGEMENT FOR A VEHICLE REFRIGERATOR AND RELATED METHOD

CROSS-REFERENCE TO RELATED APPLICATIONS

This application claims the benefit of U.S. Provisional Application No. 60/456,703, filed on Mar. 21, 2003. The disclosure of the above application is incorporated herein by reference.

FIELD OF THE INVENTION

The present invention generally relates to vehicle refrigerators. More particularly, the present invention relates to a venting arrangement for a vehicle refrigerator.

BACKGROUND OF THE INVENTION

Vehicles, including but not limited to recreational vehicles ("RVs" in the United States and "Caravans" in Europe), tractor trailers, airplanes, boats, trains, and the like, often incorporate refrigerators for the comfort and convenience of the occupants. These refrigerators are usually absorption-type refrigerators.

An absorption refrigerator includes a heat generator for heating a solution of refrigerant and an absorbent. Heat releases the refrigerant from the absorbent to form a high pressure refrigerant vapor. The refrigerant vapor is condensed in a cooling condenser. Low pressure solution from the heat generator is sprayed on the refrigerant vapor in an absorber to absorb the vapor. The absorption causes the pressure of the vapor to be reduced. Evaporation occurs in an evaporator between the condenser and the absorber. The refrigerant vapor expands in the evaporator which causes a temperature drop in the refrigerant. This temperature drop is used to provide cooling to the refrigerator. The solution of refrigerant and absorbent is then pumped back to the heat generator.

Airflow over the condenser and absorber is conventionally used for cooling of these elements. To create this airflow, which is also used to supply air for the combustion at the burner, a first duct or vent is provided through the vehicle wall for air intake. An exhaust is provided through a second duct or vent in the vehicle wall. One such arrangement is shown in commonly assigned U.S. Ser. No. 60/331,083. U.S. Ser. No. 60/331,083 is hereby incorporated by reference as if fully set forth herein.

Vehicle refrigerators such as those described above conventionally vent the combustion exhaust gases by one of two methods. In the first method, an exhaust tube assembly (consisting of one or more components) which is affixed to the refrigerator's cooling unit flue tube is used to couple the combustion exhaust gases directly out through the vehicle sidewall to the outside. In some installations this is accomplished through a hole through the vehicle sidewall; in other installations this is accomplished by attaching the exhaust tube assembly to a specially designed upper vent assembly. In the second method, the refrigerator's cooling unit flue tube vents the combustion exhaust gases unrestricted into the ventilation space and the gases exit the vehicle through the upper vent along with the ventilation air provided for the absorber and condenser.

While both conventional methods for ventilation of the combustion exhaust gases have been proven to be acceptable for their intended uses, both are associated with limitations. In the first method, proper positioning of the exhaust tube assembly relative to the vent openings is time consuming. In one known arrangement, the flue tube is coupled directly to a portion of a vent and the flue tube exhaust is discharged directly out of the vehicle. In this type of arrangement, the original equipment manufacturer (OEM) must cut the final portion of the flue tube to length in order to accommodate variations in both height and distance from the vehicle wall. The OEM must also couple the flue tube to the vent. Extending the flue tube through an independent hole in the wall is even further time consuming. In the second method, the relatively hot combustion exhaust gases mix with the ventilation air. The resultant mixture is warmer and therefore less efficient for cooling the absorber and condenser of the refrigerator's cooling unit.

Accordingly, it remains a need in the pertinent art to provide a venting arrangement for a vehicle refrigerator that overcomes the limitations associated with the prior known arrangements, including but not limited to those disadvantages discussed above.

SUMMARY OF THE INVENTION

In one form, the present invention provides a venting arrangement for a vehicle refrigerator.

The venting arrangement includes a lower vent assembly and an upper vent assembly. The lower vent assembly provides ventilation intake for cooling of refrigeration components.

The upper vent assembly provides ventilation exhaust for cooling of refrigeration components. The venting arrangement further includes a flue exhaust tube assembly. The flue exhaust tube assembly causes the combustion exhaust gases to mix with the ventilation air prior to being exhausted near the upper vent assembly and away from the refrigerator components.

It is an object of the present invention to provide a venting arrangement for a vehicle refrigerator which promotes mixing of the combustion exhaust gases with ventilation air prior to exiting the vent in a space located away from the refrigerator components through the use of a flue exhaust tube assembly.

It is a related object of the present invention to provide a venting arrangement for a vehicle refrigerator which mixes combustion exhaust gases with ventilation of air prior to exiting a vent in a space located away from the refrigerator components.

It is a related object of the present invention to provide a venting arrangement for a vehicle refrigerator that improves cooling efficiency by increasing the usable surface area of an upper vent assembly and increases the amount of ventilation air which can be delivered.

It is a related object of the present invention to provide a venting arrangement for a vehicle refrigerator which mixes the combustion exhaust gases with ventilation air prior to exiting the vent in a space located away from the refrigerator components to further increase the cooling efficiency of the ventilation air by keeping the hot combustion exhaust gases away from the refrigerator components being cooled by the ventilation air.

It is a related object of the present invention to provide a venting arrangement for a vehicle refrigerator in which a flue exhaust tube assembly is easily adjustable in both height and depth.

It is a related object of the present invention to provide a venting arrangement for a vehicle refrigerator in which the flue exhaust tube assembly's efficiency can be enhanced through the use of a shield or other such attachment which adapts or modifies the flow of the combustion exhaust gases.

It is a related object of the present invention to provide a venting arrangement for a vehicle refrigerator in which the efficiency of an upper vent assembly can be enhanced by providing a hood which protrudes inward to the ventilation space.

It is a related object of the present invention to provide a venting arrangement for a vehicle refrigerator that reduces OEM assembly time.

It is another object of the present invention to provide a venting arrangement for a vehicle refrigerator that reduces the number of the exhaust tube components.

It is another object of the present invention to provide a venting arrangement for a vehicle refrigerator that increases airflow over the back of the refrigerator through reduced resistance and increased chimney effect.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments of the present invention is merely exemplary in nature and is in no way intended to limit the invention, its application, or uses.

Figure 1:
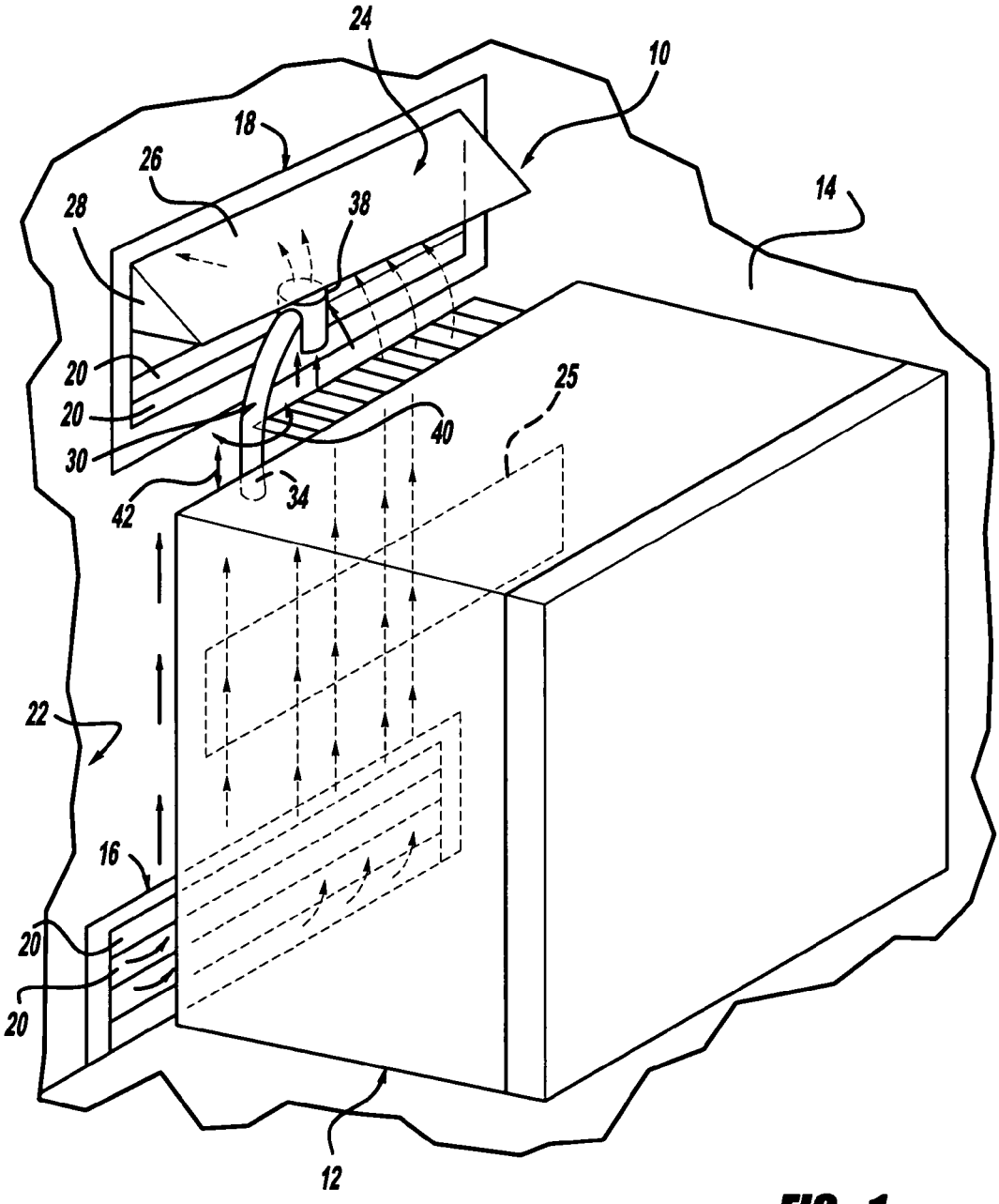
FIG. 1 is an environmental view of a venting arrangement for a vehicle refrigerator constructed according to the teachings of the present invention, the venting arrangement shown operatively associated with the vehicle refrigerator and installed within a vehicle.

Referring initially to FIG. 1, a venting arrangement for a vehicle refrigerator constructed in accordance with the teachings of the present invention is illustrated and generally identified at reference number 10. The venting arrangement 10 is shown operatively associated with a vehicle refrigerator 12 that is conventionally installed within a vehicle 14. In the exemplary arrangement illustrated, the vehicle is a recreational vehicle 14. It will become apparent to those skilled in the art, however, that the teachings of the present invention are not so limited. In this regard, the teachings of the present invention have application for any vehicle incorporating a refrigerator requiring the discharge of flue gases.

Figure 3:
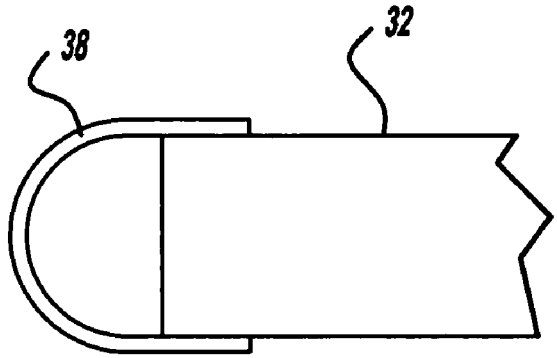
FIG. 3 is a top view of a portion of the flue exhaust tube illustrating attachment of the flue exhaust tube shield.
Figure 4:
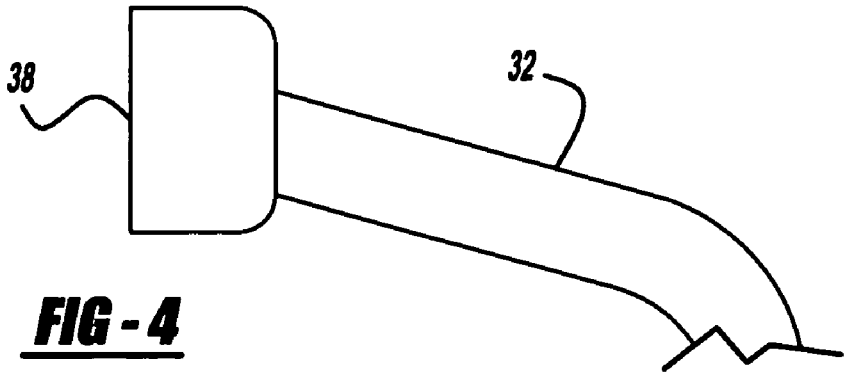
FIG. 4 is a side view of a portion of the flue exhaust tube further illustrating attachment of the flue exhaust tube shield.

With continued reference to FIG. 1 and additional reference to FIGS. 3 and 4, the teachings of the present invention will be further addressed. The venting arrangement 10 is illustrated to generally include a first or lower vent assembly 16 and a second or upper vent assembly 18. The lower vent assembly 16 includes a plurality of louvers 20 and defines an air intake for the venting arrangement 10. The lower vent assembly 16 is mounted to a wall 22 of the vehicle 14 in any manner well known in the art. One particular manner for mounting is shown and described in commonly assigned U.S. Ser. No. 60/331,083, which was incorporated by reference above.

The upper vent assembly 18 will be understood to be substantially identical to the lower vent assembly 16 with the exception that the upper vent assembly 18 further includes an inwardly directed hood or cover 24. In this regard, the upper vent assembly 18 includes a plurality of louvers 20. The upper vent assembly 18 defines an air exhaust for the venting arrangement 10 of the present invention and again is secured to the wall 22 of the vehicle 14 in any conventional manner.

In the exemplary embodiment illustrated, the upper vent assembly 18 and the lower vent assembly 16 are injection molded of a plastic material. Those skilled in the art will appreciate that other materials and manners of construction may be employed within the scope of the present invention. The upper vent assembly 18 is integrally formed to include the hood 24. As shown, the hood 24 includes an upper panel 26 which extends inward from an upper portion of the vent assembly 18. The hood 24 may include one or more triangular sides, one of which is identified at reference character 28.

The lower and upper vent assemblies 16 and 18 cooperate to define an airflow path therebetween. The airflow path provides a source of cooling air which passes across the refrigeration components (e.g., the condenser and absorber sections) of the refrigerator 12. The refrigeration components are shown schematically at reference character 25 in FIG. 1. This airflow may also provide the cooling unit flue a source of combustion air for the burner of the refrigerator 12.

Figure 2:
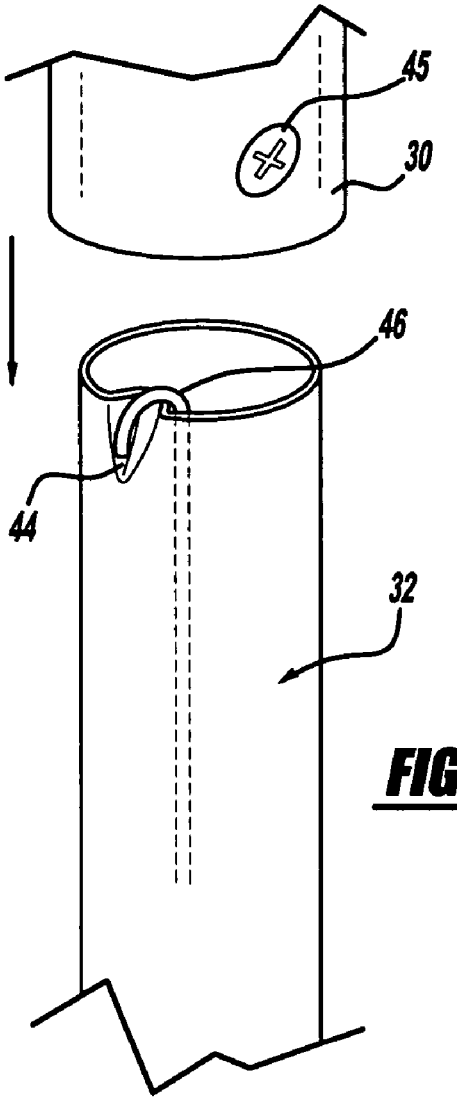
FIG. 2 is an exploded view of a portion of the venting arrangement of the present invention illustrating the connection between the cooling unit flue tube and a flue exhaust tube of the venting arrangement of the present invention.

The venting arrangement 10 of the present invention is further illustrated to include a flue exhaust tube 30 which adjustably mounts to a cooling unit flue tube 32 (see FIG. 2). The flue exhaust tube 30 may be constructed of metal or other suitable materials and generally includes a vertically oriented lower portion 34 and an angled upper portion 36. The lower portion 34 is coupled to the cooling unit flue tube 32 in a manner to be described below.

The upper portion 36 terminates at a shield 38. The shield 38 may be constructed of metal such as aluminum or other suitable materials and is welded or otherwise permanently attached to the open end of the flue exhaust tube 30. The shield 38 enhances the efficiency and effectiveness of the flue exhaust tube 30 in mixing with the cooling ventilation air by creating a small chimney effect of air with the hot combustion gases naturally rising to the top portion of the shield 38. In the embodiment illustrated, the shield 38 includes first and second sides attached to radially opposite sides of the flue exhaust tube 32.

The shield 38 deflects a horizontal component of the exhaust gases. In this manner, cooler ventilation air is drawn from the bottom as it mixes before being exhausted through the upper vent assembly 18. As will be appreciated below, the flue exhaust tube 30 is rotatably adjustable in the directions of double arrow 40 (see FIG. 1) and vertically adjustable in the directions of double arrow 42 (see FIG. 1).

In the preferred embodiment, an upper end of the cooling unit flue tube 32 is formed to include an indent 44. The indent 44 accommodates a wire 46 for the baffle while also allowing telescopic connection with a cylindrical flue exhaust tube 30. In this manner, the flue exhaust tube 30 can be rotated relative to the cooling unit flue tube 32 about an axis defined by a longitudinal axis of the cooling unit flue tube 32.

During final assembly by the OEM, the flue exhaust tube 30 is rotated relative to the cooling unit flue tube 32 such that the end of the flue exhaust tube 30 and the shield 38 are disposed below the inwardly extending hood 24. As used herein, the terms "below" and "under" will be understood to include a relationship on which the shield 38 at least partially extends into an area defined by the upper panel 26 and sides 28 of the hood 24. Importantly, the shield 38 is positioned such that the hood 24 captures the warmer air that is emitted from the flue exhaust tube 30.

With the end of the flue exhaust tube 30 and the shield 38 positioned below the hood 24, the flue exhaust tube 30 is vertically adjusted to achieve an optimum position under the hood 24. In one particular application, the flue exhaust tube 30 can be vertically adjusted approximately 100 mm. The relative positions between the flue exhaust tube 30 and cooling unit flue tube 32 can be maintained with a set screw (45).

During operation, a source of cooling air enters the lower vent assembly 16 and passes across the condenser and absorber sections of the refrigerator 12 to cool the components of the refrigerator 12. The cooling air exits the vehicle 14 at the upper vent assembly 18. The heated combustion exhaust gases exit the flue exhaust tube 30 proximate the shield 38. These combustion exhaust gases immediately mix with the cooling air moving between the lower vent assembly 16 and the upper vent assembly 18. In this manner, the flue exhaust gases are carried out of the vehicle 14 with the airflow.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A venting arrangement for a vehicle refrigerator, comprising:

a) a lower vent assembly which provides ventilation intake for cooling of refrigeration components;

b) an upper vent assembly which provides ventilation exhaust for cooling of refrigeration components; and c) a flue exhaust tube assembly which cause the combustion exhaust gases to mix with the ventilation air prior to being exhausted near the upper vent assembly and away from the refrigerator components, the exhaust tube assembly including a lower portion and an upper portion, the lower portion being generally elongated along a vertical axis, the upper portion including an end substantially spaced from the vertical axis, the upper portion rotatably coupled to the lower portion for relative rotation about the vertical axis such that the upper end is adjustable in a horizontal plane.

2. The venting arrangement for a vehicle refrigerator of claim 1, wherein the upper vent assembly includes a hood to enhance the efficiency and effectiveness of the upper vent assembly when used in combination with the flue exhaust tube assembly, the upper vent assembly being removably mountable to a wall of the vehicle.

3. The venting arrangement for a vehicle refrigerator of claim 1, further comprising a flue exhaust tube shield operative to create a small chimney effect of air with the hot combustion gases naturally rising to a top portion of the shield thus drawing cooler ventilation air from the bottom as it mixes before being exhausted through the upper vent assembly, the flue exhaust tube shield being substantially open in an upward direction.

4. The venting arrangement for a vehicle refrigerator of claim 3, wherein the flue exhaust tube shield is secured to an end of the flue exhaust tube.

5. The venting arrangement for a vehicle refrigerator of claim 4, wherein the flue exhaust tube includes an outlet and the hood is positioned above the outlet.

6. The venting arrangement for a vehicle refrigerator of claim 1, wherein the flue exhaust tube includes an outlet through which the exhaust gases are emitted and further comprising a flue exhaust tube shield secured to the flue exhaust tube proximate the outlet for deflecting a horizontal component of the exhaust gases.

7. The venting arrangement for a vehicle refrigerator of claim 3, wherein the flue exhaust tube shield is generally C-shaped and includes first and second sides secured to radially opposing sides of the flue exhaust tube.

8. The venting arrangement for a vehicle refrigerator of claim 1, in combination with the refrigerator.

9. A method of venting a vehicle refrigerator, the method comprising:

(a) providing a lower vent assembly defining a ventilation intake;

(b) providing an upper vent assembly defining a ventilation exhaust;

(c) establishing flow of ventilation air between the ventilation intake and the ventilation exhaust for cooling one or more components of the refrigerator;

(d) mixing a combustion exhaust gas of the vehicle refrigerator with the flow of ventilation air prior to expulsion of the flow of ventilation air through the upper vent assembly;

(e) routing the combustion exhaust gas through a conduit including a lower member and an upper member, the upper member including an outlet in close proximity to the ventilation exhaust; and (f) adjusting the outlet in a horizontal plane by rotating the upper member relative to the lower member about a generally vertical axis.

10. The method of claim 9, further comprising adjusting the outlet relative to the ventilation exhaust by telescoping the upper and lower members.

11. The method of claim 9, further comprising adjusting the outlet relative to the ventilation exhaust by rotating the upper member relative to the lower member.

12. The method of claim 9, further comprising deflecting the ventilation exhaust with a shield secured to the upper member.

13. A venting arrangement for a vehicle refrigerator comprising:

a flue exhaust tube assembly including a lower tube and an upper tube, the lower tube being elongated along a first axis, the upper tube mounted to the lower tube for general rotation about the first axis, the upper tube having an end defining an outlet, the outlet being substantially spaced from the first axis such that rotation of the upper tube relative to the lower tube about the first axis moves the outlet in a plane perpendicular to the first axis.

14. The venting arrangement for a vehicle refrigerator of claim 13, further comprising a flue exhaust tube shield operative to create a small chimney effect of air with the hot combustion gases naturally rising to a top portion of the shield thus drawing cooler ventilation air from the bottom as it mixes before being exhausted through the upper vent assembly, the flue exhaust tube shield being substantially open in an upward direction.

15. The venting arrangement for a vehicle refrigerator of claim 14, wherein the flue exhaust tube shield is generally C-shaped and includes first and second sides secured to radially opposing sides of the flue exhaust tube.

16. The venting arrangement for a vehicle refrigerator of claim 13, wherein the upper tube includes a lower segment and an upper segment, the lower segment elongated along the vertical axis, the upper segment extending at an angle to the vertical segment.

* * * * *